US010787862B2

(12) United States Patent
Farny et al.

(10) Patent No.: US 10,787,862 B2
(45) Date of Patent: Sep. 29, 2020

(54) DISPLACEMENT ELEMENTS IN THE MANUFACTURE OF A DRILLING TOOL

(71) Applicant: Halliburton Energy Services, Inc., Houston, TX (US)

(72) Inventors: Matthew S. Farny, Magnolia, TX (US); Garrett T. Olsen, The Woodlands, TX (US); Grant O. Cook, III, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 166 days.

(21) Appl. No.: 15/743,088

(22) PCT Filed: Aug. 10, 2015

(86) PCT No.: PCT/US2015/044495

§ 371 (c)(1),
(2) Date: Jan. 9, 2018

(87) PCT Pub. No.: WO2017/027006

PCT Pub. Date: Feb. 16, 2017

(65) Prior Publication Data

US 2019/0078389 A1 Mar. 14, 2019

(51) Int. Cl.
*E21B 10/43* (2006.01)
*E21B 10/62* (2006.01)
(Continued)

(52) U.S. Cl.
CPC ..... *E21B 10/43* (2013.01); *B22D 19/06* (2013.01); *B22D 41/08* (2013.01); *E21B 10/42* (2013.01);
(Continued)

(58) Field of Classification Search
CPC ..... E21B 10/43; E21B 10/42; E21B 10/62
See application file for complete search history.

(56) References Cited

U.S. PATENT DOCUMENTS 4,884,477 A 12/1989 Smith et al.
4,940,679 A * 7/1990 Claar ..... C04B 35/56 501/96.3

(Continued)

FOREIGN PATENT DOCUMENTS

WO 98/013159 A1 4/1998

OTHER PUBLICATIONS

International Preliminary Report on Patentability issued in related PCT Application No. PCT/US2015/044495 dated Feb. 22, 2018, 13 pages.

(Continued)

*Primary Examiner* — Blake E Michener
(74) *Attorney, Agent, or Firm* — Thomas Rooney; Baker Botts L.L.P.

(57) ABSTRACT

Drill bits for use in drilling well bores in subterranean formations, and associated systems and methods of making and using such drill bits, are provided. In certain embodiments, the drill bits comprise: a body; a plurality of blades on the body; a plurality of cutting elements on at least one of the plurality of blades; a reinforcement material forming portions of the body and the plurality of blades; a binder material infiltrated through the reinforcement material to form a composite material and forming portions of the body and the plurality of blades; and at least one interior displacement element located in an interior region of the body that is surrounded by the composite material.

20 Claims, 7 Drawing Sheets

(51) Int. Cl.

| | |
|---|---|
| ***B22D 19/06*** | (2006.01) |
| ***E21B 10/42*** | (2006.01) |
| ***B22D 41/08*** | (2006.01) |
| *C22C 29/00* | (2006.01) |

(52) U.S. Cl.
CPC ..... *E21B 10/62* (2013.01); *B22F 2998/10* (2013.01); *B22F 2999/00* (2013.01); *C22C 29/00* (2013.01); *C22C 29/005* (2013.01)

(56) References Cited

U.S. PATENT DOCUMENTS

| | | | | |
|---|---|---|---|---|
| 5,433,280 | A * | 7/1995 | Smith | B22F 3/1055 175/336 |
| 6,220,117 | B1 * | 4/2001 | Butcher | B22D 19/06 175/425 |
| 8,439,136 | B2 | 5/2013 | Jones et al. | |
| 8,789,625 | B2 | 7/2014 | Mirchandani et al. | |
| 8,839,886 | B2 | 9/2014 | Jones et al. | |
| 8,945,720 | B2 | 2/2015 | Sreshta et al. | |
| 2002/0175006 | A1 | 11/2002 | Findley et al. | |
| 2010/0116557 | A1 | 5/2010 | Lockwood et al. | |
| 2010/0307838 | A1 * | 12/2010 | Stevens | E21B 10/42 175/374 |
| 2013/0247475 | A1 | 9/2013 | Lind et al. | |
| 2015/0368980 | A1 * | 12/2015 | Cook, III | E21B 10/46 175/374 |
| 2017/0342779 | A1 * | 11/2017 | Cook, III | E21B 10/42 |
| 2018/0010393 | A1 * | 1/2018 | Cook, III | E21B 10/43 |
| 2018/0142521 | A1 * | 5/2018 | Voglewede | E21B 10/42 |

OTHER PUBLICATIONS

International Search Report and Written Opinion issued in related PCT Application No. PCT/US2015/044495 dated May 4, 2016, 16 pages.

* cited by examiner

DISPLACEMENT ELEMENTS IN THE MANUFACTURE OF A DRILLING TOOL

CROSS-REFERENCE TO RELATED APPLICATION

The present application is a U.S. National Stage Application of International Application No. PCT/US2015/044495 filed Aug. 10, 2015, which is incorporated herein by reference in its entirety for all purposes.

TECHNICAL FIELD

The present disclosure relates generally to drilling tools, such as earth-boring drill bits.

BACKGROUND

Various types of drilling tools including, but not limited to, rotary drill bits, reamers, core bits, under reamers, hole openers, stabilizers, and other downhole tools are used to form wellbores in downhole formations. Examples of rotary drill bits include, but are not limited to, fixed-cutter drill bits, drag bits, polycrystalline diamond compact (PDC) drill bits, matrix drill bits, and hybrid bits associated with forming oil and gas wells extending through one or more downhole formations.

Matrix drill bits are typically formed by placing loose reinforcement material such as tungsten carbide, typically in powder form, into a mold and infiltrating the reinforcement material with a binder material such as a copper alloy. The reinforcement material infiltrated with a molten metal alloy or binder material may form a matrix bit body after solidification of the binder material with the reinforcement material. Hybrid bits containing matrix drill bit features may be formed in a similar manner.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

When drilling a well in a subterranean formation, various downhole tools, including drill bits, coring bits, reamers, and/or hole enlargers, may be lowered in a wellbore. Some of these tools may have tool bodies comprising a metal-matrix composite (MMC). According to various systems and methods disclosed herein, such MMC structures may be formed by placing loose reinforcement material, e.g., in powder form, into a mold and infiltrating the reinforcement material with a binder material. The reinforcement material infiltrated with a molten metal alloy or binder material may form an MMC bit body after solidification of the binder material with the reinforcement material.

Metal-matrix composites manufactured using these techniques typically exhibit high strength, but may be relatively brittle or susceptible to propagation of cracks therein. According to various systems and methods disclosed herein, one or more interior displacement elements may be placed within a mold for the drill bit during manufacturing, which may be configured to displace the reinforcement material from interior portions of the drill bit and/or reduce the total amount of reinforcement material and/or binder material needed (and its associated cost) in the manufacture of the drill bit. As used herein, the interior displacement elements of the present disclosure are solid displacement materials that are located within a drill bit or a mold for a drill bit in a region corresponding to an interior region of the drill bit such that they will be surrounded by the metal-matrix composite material. As used herein, a material may be deemed to "surround" an interior displacement element despite a limited number of standoff materials or spacers are placed at certain contact points between the interior displacement element and other components in the mold, as described further below. In some embodiments, the interior displacement element may facilitate the formation of regions within the bit that are relatively binder-rich in that they comprise lesser amounts of reinforcement material and thus may exhibit different properties from the remainder of the bit. In other embodiments, the interior displacement element may facilitate the formation of hollow regions within the bit that do not comprise a significant amount of reinforcement material or binder material. In some embodiments, the interior displacement elements may be placed in a region of the bit where typical properties of an MMC material (e.g., high strength) may be less critical, or where enhanced toughness or reduced brittleness may be desired.

Figure 1:
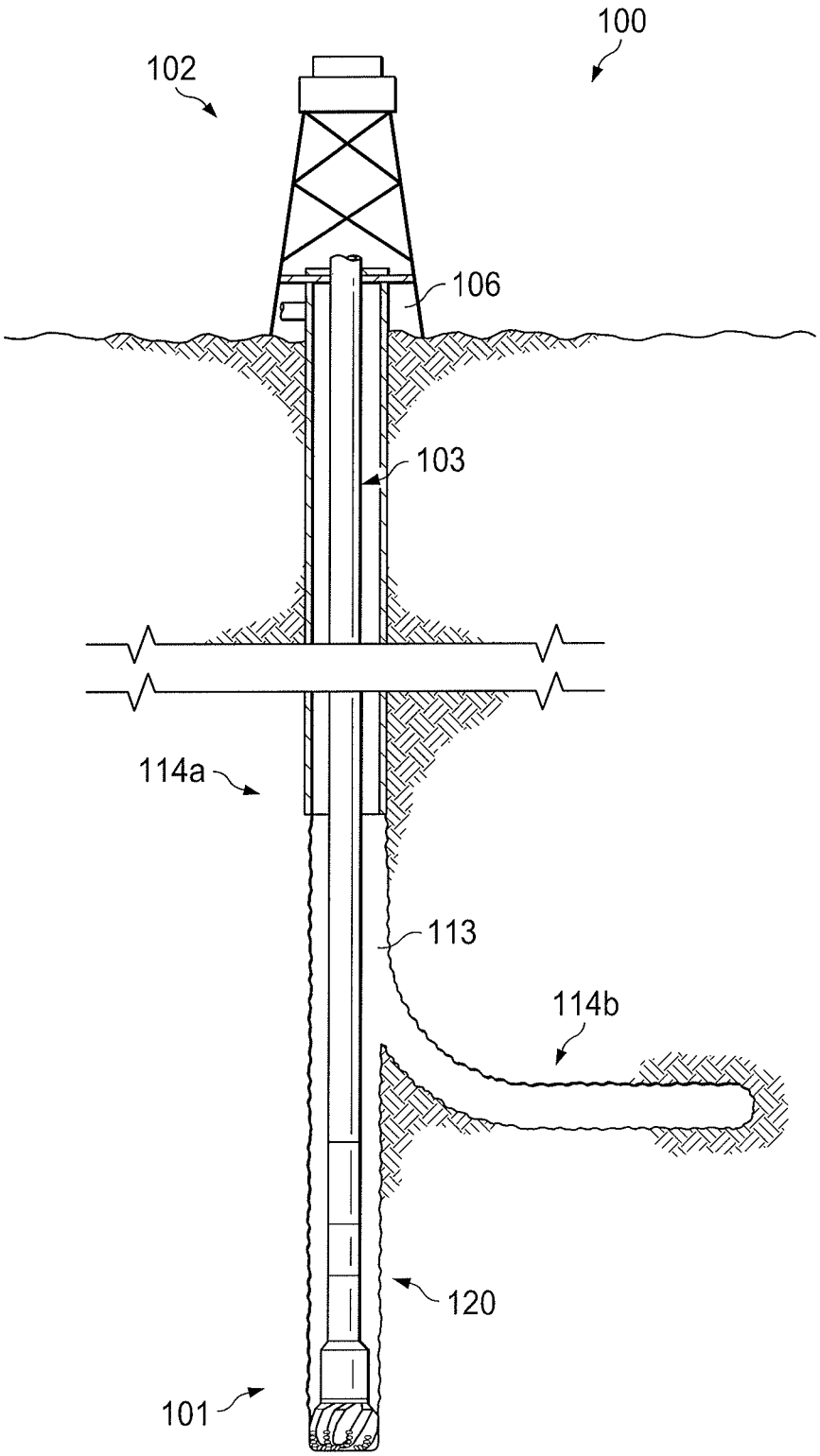
FIG. 1 is a diagram of an elevation view of a drilling system according to certain embodiments of the present disclosure.

FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may be used to drill and/or form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater-than-normal variations associated with vertical wellbores. Direction drilling may include horizontal drilling.

Drilling system 100 may also include rotary drill bit (drill bit) 101. Drill bit 101, discussed in further detail in FIG. 2, may be an MMC drill bit which may be formed by placing loose reinforcement material including tungsten carbide powder, into a mold and infiltrating the reinforcement material with a binder material including a copper alloy and/or an aluminum alloy. The mold may be formed by milling a block of material, such as graphite, to define a mold cavity having features that correspond generally with the exterior features of drill bit 101.

Figure 2:
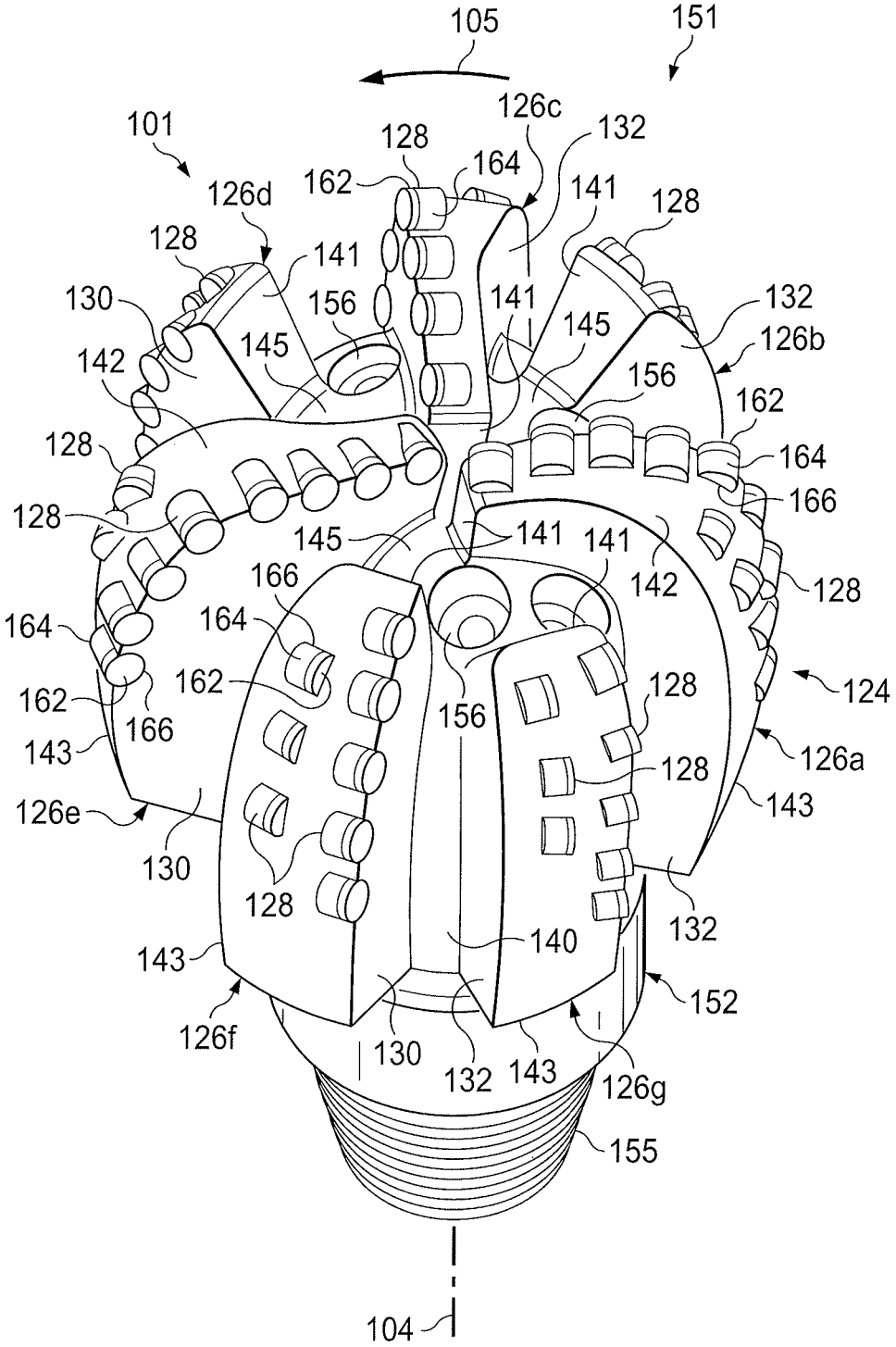
FIG. 2 is a diagram of an isometric view of a rotary drill bit oriented upwardly according to certain embodiments of the present disclosure.

FIG. 2 is an isometric view of an example configuration of the rotary drill bit 101 of FIG. 1. The present view is oriented upwardly in a manner often used to model or design fixed-cutter drill bits. To the extent that at least a portion of the drill bit is formed of an MMC, the drill bit may be any of various types of fixed-cutter drill bits, including PDC bits, drag bits, matrix-body drill bits, steel-body drill bits, and the like operable to form wellbore 114 (as illustrated in FIG. 1) extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 that may be disposed outwardly from exterior portions of rotary bit body 124 of drill bit 101. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

During a subterranean operation, different regions of drill bit 101 may be exposed to different forces and/or stresses. During manufacturing of drill bit 101, the properties of drill bit 101 may be customized such that some regions of drill bit 101 may have different properties from other regions of drill bit 101, including but not limited to enhanced toughness, resistance to crack propagation, and reduced brittleness. The localized properties may be achieved by placing a selected type of displacement element in selected locations and in selected configurations in a mold for drill bit 101. The type, location, and/or configuration of the interior displacement element may be selected to provide localized properties for drill bit 101 based on the downhole conditions experienced by the region of drill bit 101 and/or the function of the region of drill bit 101.

Drill bit 101 may be an MMC drill bit which may be formed by placing loose reinforcement material, including tungsten carbide powder, into a mold and infiltrating the reinforcement material with a binder material, which may be a copper alloy. During the mold loading process, one or more displacement elements may be placed in selected locations of the mold corresponding to the interior of drill bit 101. The reinforcement material (and, in some cases, the interior displacement element) may be infiltrated with the molten binder material to form bit body 124 after solidification of the binder material.

The mold may be formed by milling a block of material, such as graphite, to define a mold cavity having features that correspond generally with the exterior features of drill bit 101. Various features of drill bit 101 including blades 126, cutter pockets 166, and/or fluid flow passageways may be provided by shaping the mold cavity and/or by positioning temporary displacement elements within interior portions of the mold cavity. A preformed steel shank or bit mandrel (sometimes referred to as a blank) may be placed within the mold cavity to provide reinforcement for bit body 124 and to allow attachment of drill bit 101 with a drill string and/or BHA. A quantity of reinforcement material may be placed within the mold cavity and infiltrated with a molten binder material to form bit body 124 after solidification of the binder material with the reinforcement material.

Prior to or during the mold loading process, one or more interior displacement elements may be placed in selected locations of the mold to displace the reinforcement material from certain interior regions within drill bit 101. The interior displacement elements may be placed in a variety of configurations based on the selected localized properties for the regions of drill bit 101 in which the interior displacement element is placed, as described in more detail with reference to FIGS. 4-7 below. For example, in certain embodiments, the interior displacement element may be placed in certain regions closer to the central axis of the body of drill bit 101 since these regions may not experience high levels of stress.

Drill bit 101 may include shank 152 with drill pipe threads 155 formed thereon. Threads 155 may be used to releasably engage drill bit 101 with a bottom hole assembly (such as BHA 120 shown in FIG. 1) whereby drill bit 101 may be rotated relative to bit rotational axis 104. Plurality of blades 126*a*-126*g* may have respective junk slots or fluid flow paths 140 disposed therebetween.

Drilling fluids may be communicated to one or more nozzles 156. The regions of drill bit 101 near nozzle 156 may be subject to stresses during the subterranean operation that may cause cracks in drill bit 101. Thus, in some embodiments, an interior displacement element may be placed near nozzles 156 to increase the toughness and/or crack-arresting properties of the region of the drill bit near nozzles 156.

Drill bit 101 may include one or more blades 126*a*-126*g*, collectively referred to as blades 126, that may be disposed outwardly from exterior portions of rotary bit body 124. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with the teachings of the present disclosure may have a wide variety of configurations including, but not limited to, substantially arched, helical, spiraling, tapered, converging, diverging, symmetrical, and/or asymmetrical.

Each of blades 126 may include a first end 141 disposed proximate or toward bit rotational axis 104 and a second end 143 disposed proximate or toward exterior portions of drill bit 101 (i.e., disposed generally away from bit rotational axis 104 and toward uphole portions of drill bit 101). Blades 126 may have apex 142 that may correspond to the portion of blade 126 furthest from bit body 124 and blades 126 may join bit body 124 at landing 145.

In some cases, blades 126 may have substantially arched configurations, generally helical configurations, spiral shaped configurations, or any other configuration satisfactory for use with each drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and other suitable elements may be described as forming portions of the bit face.

Blades 126*a*-126*g* may include primary blades disposed about bit rotational axis 104. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. In some configurations, blades 126*a*-126*g* may also include at least one secondary blade disposed between the primary blades. Blades 126*b*, 126*d*, 126*f*, and 126*g* shown in FIG. 2 on drill bit 101 may be secondary blades or minor blades because respective first ends 141 may be disposed on downhole end 151 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the disposition may be based on the downhole drilling conditions of the drilling environment. In some cases, blades 126 and drill bit 101 may rotate about rotational axis 104 in a direction defined by directional arrow 105.

Each blade may have a leading (or front) surface 130 disposed on one side of the blade in the direction of rotation of drill bit 101 and a trailing (or back) surface 132 disposed on an opposite side of the blade away from the direction of rotation of drill bit 101. Blades 126 may be positioned along bit body 124 such that they have a spiral configuration relative to rotational axis 104. In other configurations, blades 126 may be positioned along bit body 124 in a generally parallel configuration with respect to each other and bit rotational axis 104. The leading side of the root or base portion of blades 126 may be subjected to relatively high stresses when the drill bit 101 is used in subterranean operations. Thus, in certain embodiments, it may be less desirable to place displacement elements in those regions of the drill bit 101.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Cutting elements 128 may be any suitable device configured to cut into a formation, including but not limited to, primary cutting elements, back-up cutting elements, secondary cutting elements, or any combination thereof. By way of example and not limitation, cutting elements 128 may be various types of cutters, compacts, buttons, inserts, and gage cutters satisfactory for use with a wide variety of drill bits 101. Cutting elements 128 may be set on the surfaces of the blades 126, brazed to the surfaces of blades 126, or otherwise attached to blades 126 by any other suitable means.

Cutting elements 128 may include respective substrates with a layer of hard cutting material, including cutting table 162, disposed on one end of each respective substrate, including substrate 164. Blades 126 may include recesses or cutter pockets 166 that may be configured to receive cutting elements 128. For example, cutter pockets 166 may be concave cutouts on blades 126. Cutter pockets 166 may be subject to impact forces during the subterranean operation.

Blades 126 may further include one or more gage pads (not expressly shown) disposed on blades 126. A gage pad may be a gage, gage segment, or gage portion disposed on exterior portion of blade 126. Gage pads may often contact adjacent portions of wellbore 114 formed by drill bit 101. Exterior portions of blades 126 and/or associated gage pads may be disposed at various angles, positive, negative, and/or parallel, relative to adjacent portions of generally vertical portions of wellbore 114. A gage pad may include one or more layers of hardfacing material.

Figure 3:
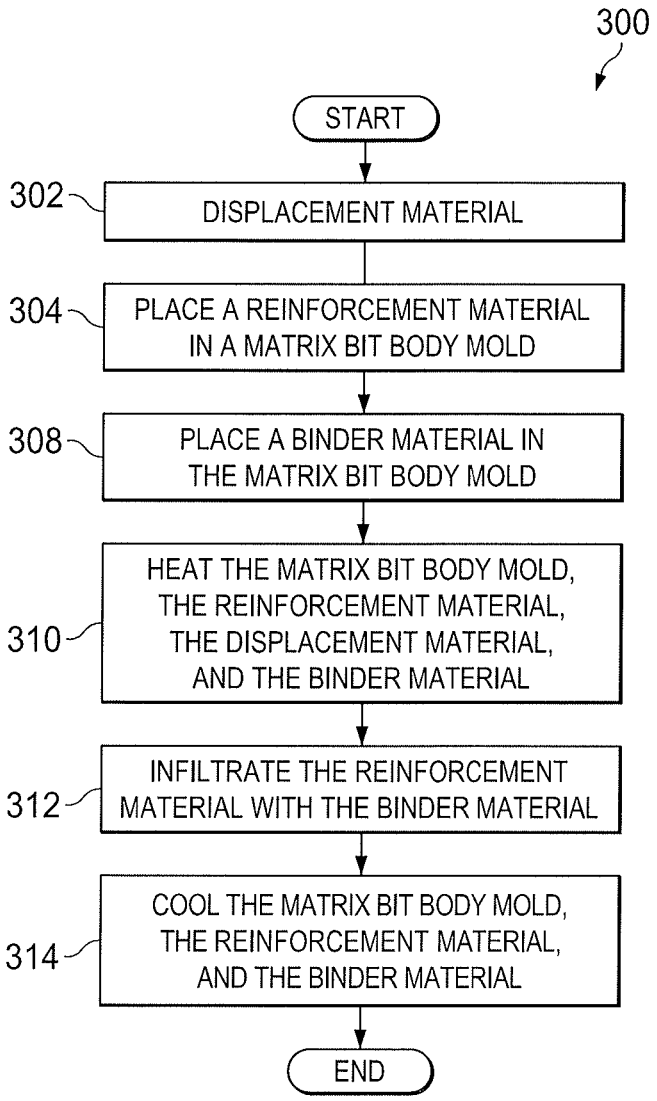
FIG. 3 is a flow chart of an example method of forming an MMC drill bit according to certain embodiments of the present disclosure.

Drill bits, such as drill bit 101, may be formed using a mold assembly. FIG. 3 is a flow chart of an example method of forming a metal-matrix composite drill bit having localized properties. The steps of method 300 may be performed by a person or manufacturing device (referred to as a manufacturer) that is configured to fill molds used to form MMC drill bits.

Method 300 may begin at step 302 in which the manufacturer may place one or more displacement elements in a matrix bit body mold in a location corresponding to an interior region within the bit body (e.g., not in contact or communication with an outer surface of the bit body). The matrix bit body mold may be similar to the mold described with respect to FIG. 4. The interior displacement elements used in the methods and drill bits of the present disclosure may comprise any solid material that is sufficiently rigid to support the weight of the reinforcement material and the binder material that will be placed on top of and/or around it without being crushed or undesirably compressed or deformed (although some deformation or compression may be acceptable). Examples of materials that the interior displacement elements may comprise include, but are not limited to metals, alloys, ceramics, cements, polymers, fibers, wool, and any combination thereof. In certain embodiments, an interior displacement element may comprise a combination of materials, for example, with a structure or matrix made of one material whose outer surface is coated with another material. Alternatively, in certain embodiments, an interior displacement element may be encapsulated in a structure or material that is refractory to the process and retains the interior displacement element in place during the infiltration process. In the embodiments of the present disclosure, the interior displacement elements of the present disclosure may be foam displacement elements that comprises one or more porous foam materials (e.g., open-cell or closed-cell foam). In certain embodiments, an interior foam displacement element of the present disclosure may be encapsulated in a structure or material that is refractory to the process and retains the foam in place during the infiltration process.

The interior displacement elements according to the present disclosure may be completely pre-formed (e.g., molded, machined, etc.) prior to the manufacturing of the drill bit (e.g., by a vendor other than the manufacturer of the drill bit), or they may be formed at least in part during the manufacture of the drill bit. The interior displacement elements may be provided in the form of hollow structures, porous structures (e.g., open-cell or closed-cell structures), fibrous structures, and the like, and may be of any suitable size and/or shape. In some embodiments, the interior displacement element may comprise a hollow structure with one or more holes or openings in the surface, allowing the hollow region to be filled with binder material (as discussed below) or another material in the course of the manufacturing process. For example, the displacement material may comprise a hollow ceramic shell, which may be filled with ceramic or metallic powder. The hollow shell may be filled with powder before it is placed in the mold, or it may be fabricated with holes or openings therein which allow the powder to enter the interior of the shell as it is loaded into the mold. In certain embodiments, one or more standoff materials or spacers may be placed at certain contact points between the interior displacement element and other components in the mold, among other reasons, to retain the interior displacement element in place during the mold loading process.

In some embodiments, the size, shape, composition, configuration, and/or placement of the interior displacement element may depend on the forces and/or stresses experienced by particular portions of the drill bit and the desired localized properties in those portions of the bit. For example, the strength, brittleness, and/or other properties of the drill bit may be affected by the size, shape, composition, configuration, and/or location of the interior displacement elements within the mold used to manufacture the bit. Examples of different configurations for the interior displacement elements are shown in FIGS. 4-7, which are discussed in greater detail below.

At step 304, the manufacturer may place a reinforcement material in the matrix bit body mold. In certain embodiments of the present disclosure, the interior displacement elements may be layered with or otherwise placed within the mold in a manner that allows the reinforcement material to at least partially surround the interior displacement elements. For example, in some embodiments, a first portion of the reinforcement material may have been placed in the matrix bit body mold prior to placing the interior displacement elements into the mold, followed by a second portion of the reinforcement material, among other reasons, to more easily place the interior displacement elements in the desired location in the mold. Depending upon the structure of the interior displacement elements, the reinforcement material may enter certain regions within the interior displacement elements, e.g., openings in the surface or porous or hollow regions of the interior displacement element connected to the outer surface thereof. However, these regions may comprise significantly less of the reinforcement material than the regions within the mold where displacement elements are not placed.

The reinforcement material may be selected to provide designed characteristics for the resulting drill bit, such as strength, fracture resistance, toughness, and/or erosion, abrasion, and wear resistance. The reinforcement material may be any suitable material, such as, but are not limited to, particles of metals, metal alloys, superalloys, intermetallics, borides, carbides, nitrides, oxides, silicides, ceramics, diamonds, and the like, or any combination thereof. More particularly, examples of reinforcing particles suitable for use in conjunction with the embodiments described herein may include particles that include, but are not limited to, tungsten, molybdenum, niobium, tantalum, rhenium, iridium, ruthenium, beryllium, titanium, chromium, rhodium, iron, cobalt, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (e.g., nickel-chromium containing alloys, available from Haynes International), INCONEL® alloys (e.g., austenitic nickel-chromium containing superalloys available from Special Metals Corporation), WASPALOYS® (e.g., austenitic nickel-based superalloys), RENE® alloys (e.g., nickel-chromium containing alloys available from Altemp Alloys, Inc.), HAYNES® alloys (e.g., nickel-chromium containing superalloys available from Haynes International), INCOLOY® alloys (e.g., iron-nickel containing superalloys available from Mega Mex), MP98T (e.g., a nickel-copper-chromium superalloy available from SPS Technologies), TMS alloys, CMSX® alloys (e.g., nickel-based superalloys available from C-M Group), cobalt alloy 6B (e.g., cobalt-based superalloy available from HPA), N-155 alloys, any mixture thereof, and any combination thereof. In some embodiments, the reinforcing particles may be coated. In some cases, multiple different types of reinforcement material may be used to form a single resulting drill bit.

At step 308, the manufacturer may place a binder material in the matrix bit body mold. The binder material may be placed in the mold after the reinforcement material has been packed into the mold. The binder material may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. The binder material may be selected such that the downhole temperatures during the subterranean operation are less than the melting point of the binder material.

At step 310, the manufacturer may heat the matrix bit body mold and the materials disposed therein via any suitable heating mechanism, including a furnace. When the temperature of the binder material exceeds the melting point of the binder material, the liquid binder material may flow into the reinforcement material (and, in some cases, the interior displacement elements).

At step 312, as the binder material infiltrates the reinforcement material, the binder material may additionally infiltrate the interior displacement elements. For example, if an interior displacement element comprises a porous material or a hollow structure with one or more holes or openings in the outer surface thereof, the binder material may penetrate those pores, holes, openings, or passages therein and infiltrate the interior of the interior displacement element and/or interlock with it. If the reinforcement material did not substantially enter these regions of the interior displacement element, this may result in the formation of relatively "binder-rich" regions of the drill bit that comprise a relatively larger proportion of the binder. In other embodiments, if the interior displacement element comprises a solid, hollow, or closed-cell structure that does not permit the binder material to penetrate its surface, that region of the drill bit may not comprise a significant amount of binder material or reinforcement material, and may simply comprise the interior displacement element as formed. Depending on the type of material of which the interior displacement element is comprised, the interior displacement element may remain intact through the manufacturing process and remain in place in the resulting drill bit. In other embodiments, the interior displacement element may comprise a material that melts, dissolves, burns, or otherwise degrades at some point after the binder material is introduced into the mold. If this occurs prior to or during the infiltration of the binder material, the binder material may fill in the regions previously occupied by the interior displacement element, resulting in the formation of relatively "binder-rich" regions of the bit. If the interior displacement element remains intact as the binder material infiltrates the reinforcement material but is subsequently melted, dissolved, burned, or otherwise degraded, this may result in the formation of one or more voids or empty spaces in the regions previously occupied by the interior displacement element.

At step 314, the manufacturer may cool the matrix bit body mold, the reinforcement material, the binder material, and the interior displacement element. The cooling may occur at a controlled rate. After the cooling process is complete, the mold may be broken away to expose the body of the resulting drill bit. The resulting drill bit body may be subjected to further manufacturing processes (e.g., machining) to complete the drill bit.

Figure 4:
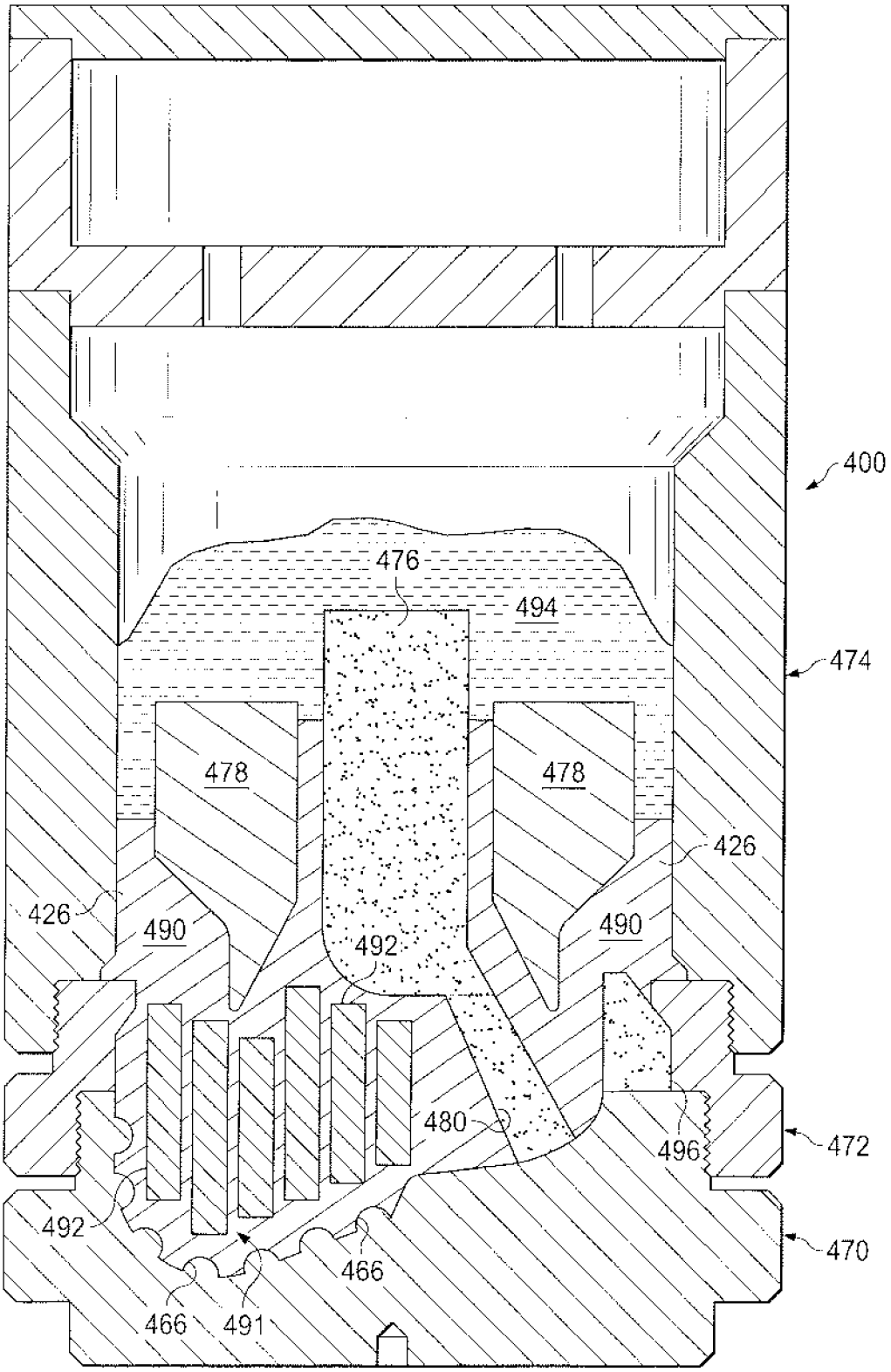
FIG. 4 is a schematic drawing in section with portions broken away showing an example of a mold assembly used to manufacture an MMC drill bit according to certain embodiments of the present disclosure.

FIG. 4 is a schematic drawing in section with portions broken away showing an example of a mold assembly in accordance with certain embodiments of the present disclosure. Mold assembly 400 may include mold 470, gauge ring 472, and funnel 474 which may be formed of any suitable material, such as graphite. Gauge ring 472 may be threaded to couple with the top of mold 470 and funnel 474 may be threaded to couple with the top of gauge ring 472. Funnel 474 may be used to extend mold assembly 400 to a height based on the size of the drill bit to be manufactured using mold assembly 400. The components of mold assembly 400 may be created using any suitable manufacturing process, such as casting and/or machining. The shape of mold assembly 400 may have a reverse profile from the exterior features of the drill bit to be formed using mold assembly 400 (the resulting drill bit).

Interior displacement elements 492 are shown positioned in an interior region 491 of an MMC drill bit. In the embodiment shown, displacement elements 492 are in the shapes of rings, rods, pellets, and/or spheres. However, interior displacement elements 492 may have various sizes and shapes as mentioned above. For example, interior displacement elements 492 may have a geometric shape, including a cube, sphere, star, ring, rectangular prism, and/or parallelepiped shape, or may be in foils or plates. In certain embodiments, the interior displacement elements may have regular shapes, irregular shapes, or a combination thereof, and multiple displacement elements used in the manufacture of a single drill bit may have the same shape or different shapes.

In some cases, various types of additional displacements and/or mold inserts such as junk slot displacement 496 may be installed within mold assembly 400, depending on the configuration of the resulting drill bit. The additional displacements and/or mold inserts may be formed from any suitable material, such as consolidated sand and/or graphite. The additional displacements and/or mold inserts may be used to form voids in the surface of the resulting drill bit. For example, consolidated sand may be used to form core 476 and/or fluid flow passage 480, which may communicate with a nozzle, e.g., one of nozzles 156 in FIG. 2, or one of nozzles 556, 656, or 756 in FIGS. 5-7. Additionally, mold inserts (not expressly shown) may be placed within mold assembly 400 to form pockets 466 in blade 426. Cutting elements, including cutting elements 128 shown in FIG. 2, may be attached to pockets 466, as described with respect to cutter pockets 166 in FIG. 2.

A generally hollow, cylindrical metal mandrel 478 may be placed within mold assembly 400. The inner diameter of metal mandrel 478 may be larger than the outer diameter of core 476 and the outer diameter of metal mandrel 478 may be smaller than the outer diameter of the resulting drill bit. Metal mandrel 478 may be used to form a portion of the interior of the drill bit.

After interior displacement elements 492 and any additional displacements or inserts are placed within mold assembly 400, mold assembly may be filled with reinforcement material 490. Reinforcement material 490 may be selected to provide designed characteristics for the resulting drill bit, such as fracture resistance, toughness, and/or erosion, abrasion, and wear resistance. Reinforcement material 490 may be any suitable material, such as particles of metals, metal alloys, superalloys, intermetallics, borides, carbides, nitrides, oxides, silicides, ceramics, diamonds, and the like, or any combination thereof. While a single type of reinforcement material 490 is shown in FIG. 4, multiple types of reinforcement material 490 may be used.

Once reinforcement material 490 and interior displacement element 492 are loaded in mold assembly 400, reinforcement material 490 may be packed into mold assembly 400 using any suitable mechanism, such as a series of vibration cycles. The packing process may help to ensure consistent density of reinforcement material 490 and provide consistent properties throughout the portions of the resulting drill bit formed of reinforcement material 490.

After the packing of reinforcement material 490, binder material 494 may be placed on top of reinforcement material 490, core 476, and/or metal mandrel 478. Binder material 494 may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. Binder material 494 may be selected such that the downhole temperatures during the subterranean operation are less than the critical temperature or melting point of binder material 494.

Mold assembly 400 and the materials disposed therein may be heated via any suitable heating mechanism, including a furnace. When the temperature of binder material 494 exceeds the melting point of binder material 494, binder material 494 may flow into reinforcement material 490 towards mold 470. As binder material 494 infiltrates reinforcement material 490, binder material 494 may additionally infiltrate interior displacement elements 492 as described above. For example, if interior displacement elements 492 comprise open-cell porous structures or hollow shells with one or more holes or openings in the shell, the binder material 494 may flow into the interior of at least a portion of interior displacement elements 492.

Once binder material 494 has infiltrated reinforcement material 490, mold assembly 400 may be removed from the furnace and cooled at a controlled rate. After the cooling process is complete, mold assembly 400 may be broken away to expose the body of the resulting drill bit. The resulting drill bit body may be subjected to further manufacturing processes to complete the drill bit. For example, cutting elements (for example, cutting elements 128 shown in FIG. 2) may be brazed to the drill bit to couple the cutting elements to pockets 466. During the brazing process, binder material 494 and/or interior displacement elements 492 may be heated above their melting points and some additional reaction, deformation, and/or degradation of those materials may occur. For example, interior displacement elements 492 may be melted, dissolved, or burned away to leave voids within the drill bit where interior displacement elements 492 were previously located.

Figure 5:
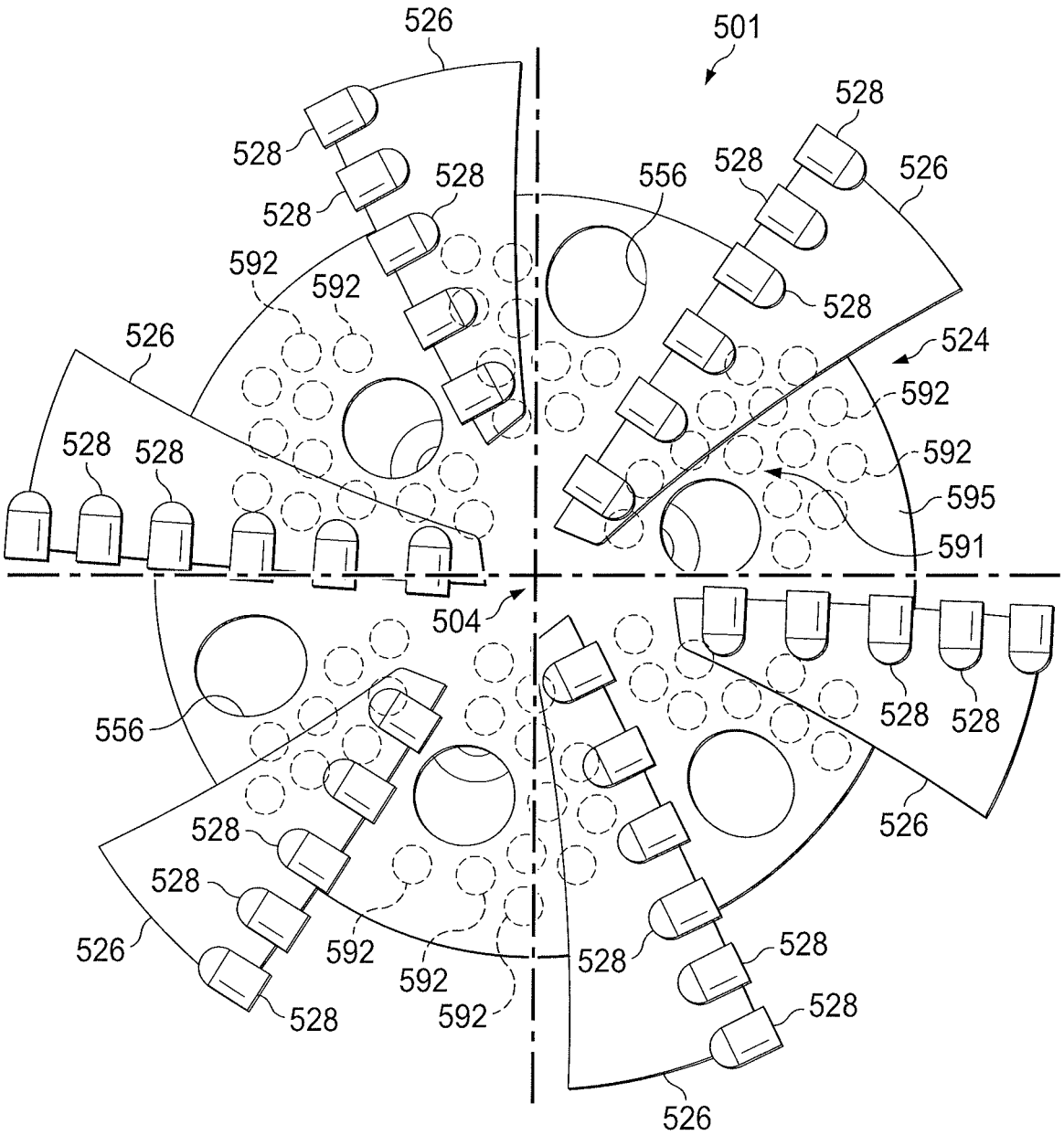
FIGS. 5-7 are diagrams showing bottom views of various drill bits similar to that shown in FIG. 2 manufactured using interior displacement elements according to certain embodiments of the present disclosure.

FIG. 5 is a diagram of bottom view of an example of a drill bit similar to that shown in FIG. 2 (viewed from above the top portion of the bit, as oriented in FIG. 2) manufactured according to the processes described with respect to FIGS. 3 and 4 above. Similar to the elements shown in FIG. 2, drill bit 501 includes a bit body 524 having a central axis 504, a plurality of blades 526 disposed outwardly from exterior portions of bit body 524, nozzles 556 formed in the bit body 524 between the blades 526, and a plurality of cutting elements 528 disposed outwardly from exterior portions of each blade 526. In the embodiment shown, bit body 524 further comprises a plurality of interior displacement elements 592 that were placed within the mold during the manufacture of the bit body. As shown, interior displacement elements 592 are located in an interior region 591 of the bit body 524 (e.g., they are surrounded by the MMC material 595), and are distributed relatively uniformly across the bit body. As shown, interior displacement elements 592 have round cross-sectional shape, and may comprise spheres or cylindrically shaped rods or pellets that were oriented vertically within the bit mold, in a manner similar to that shown for interior displacement elements 492 in FIG. 4.

Figure 6:
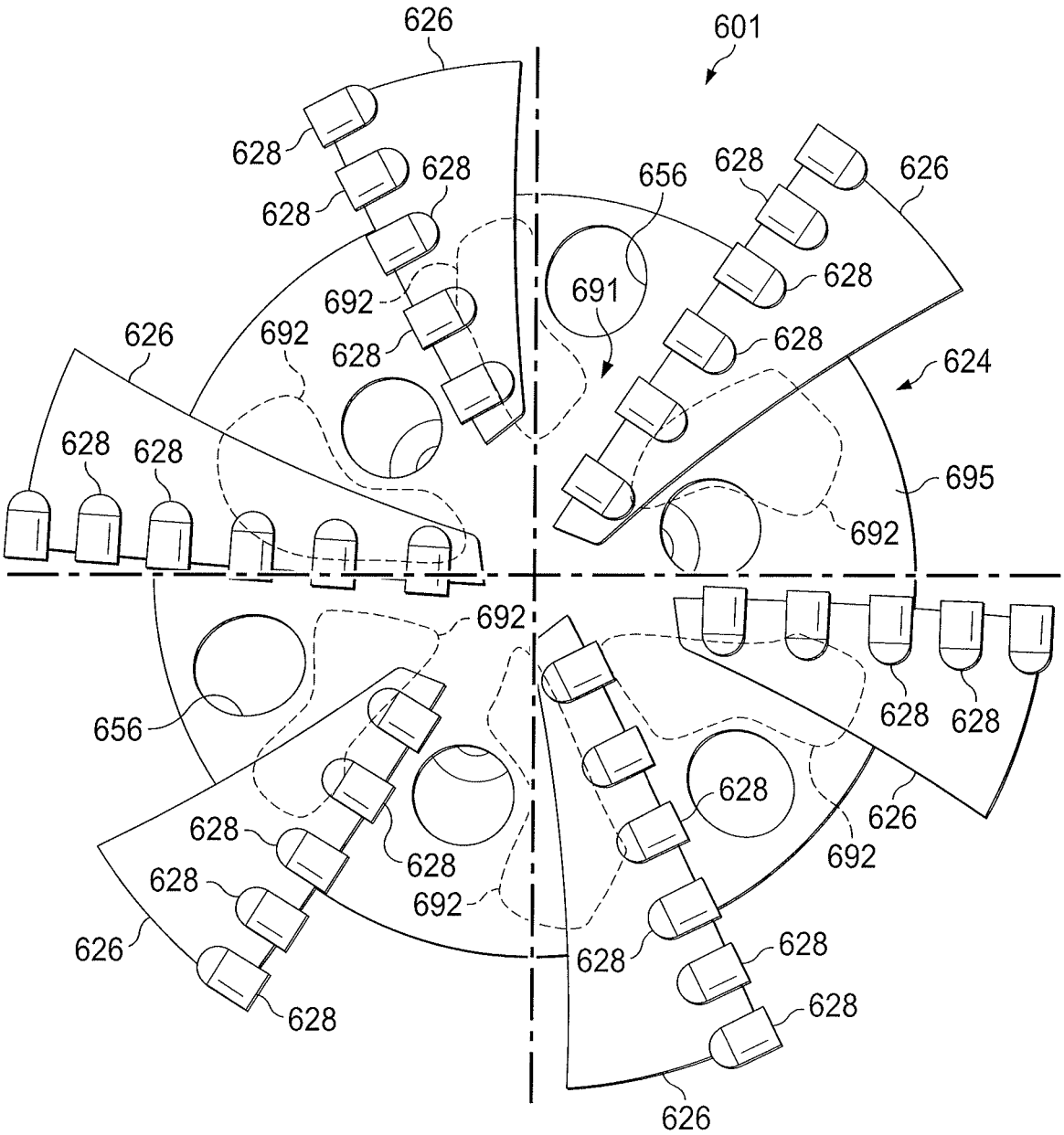

FIG. 6 is a diagram of a bottom view of another example of a drill bit similar to that shown in FIG. 2 and manufactured according to the processes described with respect to FIGS. 3 and 4 above. Similar to the elements shown in FIGS. 2 and 5, drill bit 601 includes a bit body 624 having a central axis 604, a plurality of blades 626, nozzles 656, and a plurality of cutting elements 628. In the embodiment shown, bit body 624 further comprises a plurality of interior displacement elements 692 of irregular cross-sectional shapes that were placed within the mold during the manufacture of the bit body in locations corresponding to an interior region 691 of the bit body 624 (e.g., they are surrounded by the MMC material 695). As shown, interior displacement elements 692 comprise a greater volume of the bit body 624 as compared to the interior displacement elements shown in FIG. 5, although they are generally located in the vicinity of nozzles 656.

Figure 7:
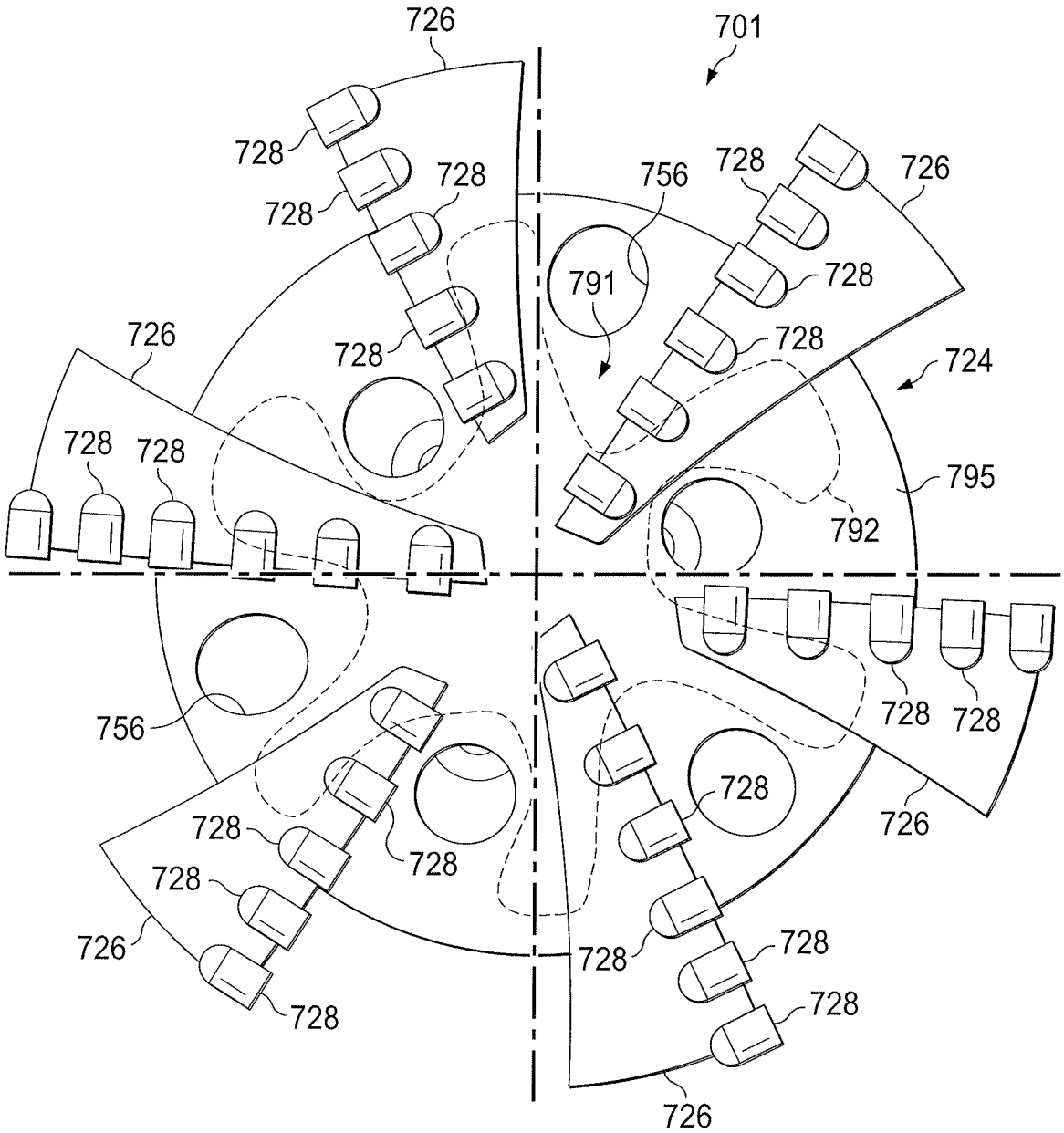

FIG. 7 is a diagram of a bottom view of another example of a drill bit similar to that shown in FIG. 2 and manufactured according to the processes described with respect to FIGS. 3 and 4 above. Similar to the elements shown in FIGS. 2, 5, and 6, drill bit 701 includes a bit body 724 having a central axis 704, a plurality of blades 726, nozzles 756, and a plurality of cutting elements 728. In the embodiment shown, bit body 724 further comprises a single interior displacement element 792 of irregular cross-sectional shape that was placed within the mold during the manufacture of the bit body in a location corresponding to an interior region 791 of the bit body 724 (e.g., surrounded by the MMC material 795). As a person of skill in the art with the benefit of this disclosure will recognize, this cross-sectional view instead could represent an embodiment in which a plurality of interior displacement elements 792 having the same cross-sectional shape shown are disposed within bit body 724 at various locations along the height of the bit body. As shown, interior displacement element 792 comprises a greater volume of the bit body 724 as compared to the interior displacement elements shown in FIGS. 5 and 6. As shown interior displacement element 792 is primarily located in the vicinity of the center (e.g., the central rotational axis 704) of the bit body 724, and extends away from the leading edges of the root portions of the blades 726 as it extends away from the center of the bit body. Due to the relatively large volume occupied by the interior displacement element 792 in FIG. 7, in certain embodiment, the durability or useful life of drill bit 701 and other drill bits having similar structures may be limited as compared to other embodiments of drill bits according to the present disclosure.

As would be understood by a person of ordinary skill in the art with the benefit of this disclosure, if the interior displacement elements shown in FIGS. 5-7 were melted, dissolved, burned, or otherwise degraded at some point during or after the manufacture of the bit, regions 592, 692, and/or 792 (or some subset thereof) in drill bits resulting from those processes may not actually represent the interior displacement elements themselves, but instead may represent "binder-rich" regions of the bit body and/or voids left where the interior displacement elements were placed during manufacture.

The regions of drill bits 101, 501, 601, and 701 corresponding to the regions near flow passage 480 in FIG. 4 and/or nozzles 156 in FIG. 2 or 556, 656, or 756 in FIGS. 5-7 may be subject to stresses during the subterranean operation that may cause cracks in drill bit 101. Thus, in some embodiments, an interior displacement element may be located in the vicinity of one or more of nozzles 156, 556, 656, or 756 among other reasons, to increase the toughness and/or crack-arresting properties of the drill bit in those regions.

The interior displacement element configurations shown in FIGS. 4-7 are provided as examples only. Any number of interior displacement element configurations are anticipated by the present disclosure. The type, shape, and size of the interior displacement element may be based on the properties selected for the region of the drill bit in which the interior displacement element is placed. Additionally the spacing between individual pieces of displacement element may vary based on the type, shape, and/or size of displacement element used and the properties selected for the region of the drill bit in which the interior displacement element is placed.

Modeling of an MMC drill bit and/or simulation of a subterranean operation may be used to obtain an analysis of the stresses to which the MMC drill bit may be subjected during the subterranean operation. The stress analysis may be used to select the type of displacement element used in the MMC drill bit, the size, shape, and/or spacing of the interior displacement element, and/or the placement of the interior displacement element.

An embodiment of the present disclosure is a drill bit comprising: a body; a plurality of blades on the body; a plurality of cutting elements on at least one of the plurality of blades; a reinforcement material forming portions of the body and the plurality of blades; a binder material infiltrated through the reinforcement material to form a composite material and forming portions of the body and the plurality of blades; and at least one interior displacement element located in an interior region of the body that is surrounded by the composite material.

Another embodiment of the present disclosure is a drill bit comprising: a body; a plurality of blades on the body; a plurality of cutting elements on at least one of the plurality of blades; a reinforcement material forming portions of the body and the plurality of blades; a binder material infiltrated through the reinforcement material to form a composite material and forming portions of the body and the plurality of blades; and at least one area located in an interior region of the body surrounded by the composite material wherein an interior displacement element at least partially displaced the reinforcement material therefrom.

Another embodiment of the present disclosure is a method of making a matrix drill bit comprising: placing at least one interior displacement element in a region of a matrix bit body mold corresponding to an interior region of a bit body formed using the matrix bit body mold; placing a reinforcement material in the matrix bit body mold; placing a binder material in the matrix bit body mold on top of the reinforcement material and surrounding the interior displacement element; heating the matrix bit body mold, the reinforcement material, the interior displacement element, and the binder material to a temperature above the melting point of the binder material; infiltrating the reinforcement material with the binder material; and cooling at least the matrix bit body mold, the reinforcement material, and the binder material to form a matrix composite drill bit body.

Another embodiment of the present disclosure is a drilling system comprising: a drill string; and a drilling tool coupled to the drill string, the drilling tool comprising: a body; a plurality of blades on the body; a plurality of cutting elements on at least one of the plurality of blades; a reinforcement material forming portions of the body and the plurality of blades; a binder material infiltrated through the reinforcement material to form a composite material and forming portions of the body and the plurality of blades; and at least one interior displacement element located in an interior region of the body that is surrounded by the composite material.

Another embodiment of the present disclosure is a method of drilling a well bore comprising: providing a drill string and a drilling tool coupled to the drill string, the drilling tool comprising a body, a plurality of blades on the body, a plurality of cutting elements on at least one of the plurality of blades, a reinforcement material forming portions of the body and the plurality of blades, a binder material infiltrated through the reinforcement material to form a composite material and forming portions of the body and the plurality of blades, and at least one interior displacement element located in an interior region of the body that is surrounded by the composite material; and using the drill string and drilling tool to drill at least a portion of a well bore penetrating at least a portion of a subterranean formation.

Another embodiment of the present disclosure is a method of drilling a well bore comprising: providing a drill string and a drilling tool coupled to the drill string, the drilling tool comprising a body, a plurality of blades on the body, a plurality of cutting elements on at least one of the plurality of blades, a reinforcement material forming portions of the body and the plurality of blades, a binder material infiltrated through the reinforcement material to form a composite material and forming portions of the body and the plurality of blades, and at least one area located in an interior region of the body surrounded by the composite material wherein an interior displacement element at least partially displaced the reinforcement material therefrom; and using the drill string and drilling tool to drill at least a portion of a well bore penetrating at least a portion of a subterranean formation.

Each of the embodiments described above may have one or more of the following additional elements in any combination:

Element 1: wherein the interior displacement element has a shape of at least one of: a pellet, a sphere, and a cylinder;

Element 2: wherein the interior displacement element comprises at least one material selected from the group consisting of: an open-cell foam, a closed-cell foam, wool, a ceramic material, a metallic material, a cement, a polymeric material, and any combination thereof;

Element 3: wherein the interior displacement element comprises a foam;

Element 4: wherein at least one of the interior displacement elements is located in the vicinity of a central axis of the body of the drill bit or one or more nozzles formed in the body of the drill bit.

Element 5: wherein the area located within the interior region of the body comprises a binder-rich area.

Element 6: wherein the area located within the interior region of the body comprises an empty space or void.

Element 7: wherein the interior displacement material melts, dissolves, or otherwise degrades prior to the step of cooling the matrix bit body mold, the reinforcement material, and the binder material.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. The terms in the claims have their plain, ordinary meaning unless otherwise explicitly and clearly defined by the patentee.

What is claimed is:

1. A drill bit comprising:

a body;

a plurality of blades on the body;

a plurality of cutting elements on at least one of the plurality of blades;

a reinforcement material forming portions of the body and the plurality of blades;

a binder material infiltrated through the reinforcement material to form a composite material and forming portions of the body and the plurality of blades; and at least one interior displacement element located in an interior region of the body that is surrounded by the composite material;

wherein at least one of the interior displacement elements extends in a radially outward direction away from a longitudinal axis of the drill bit through a space located between a nozzle formed in the body and a corresponding one of the plurality of blades of the body adjacent the nozzle, and wherein the interior displacement element extends laterally away from a leading edge of the corresponding one of the plurality of blades as the interior displacement element extends in the radially outward direction; and wherein the at least one interior displacement element is not distributed uniformly throughout the composite material that forms the portions of the body and the plurality of blades.

2. The drill bit of claim 1, wherein the interior displacement element comprises at least one material selected from the group consisting of: an open-cell foam, a closed-cell foam, wool, a ceramic material, a metallic material, a cement, a polymeric material, and any combination thereof.

3. The drill bit of claim 1, wherein the interior displacement element has an irregular cross-sectional shape.

4. The drill bit of claim 1, wherein the interior displacement element comprises a foam.

5. The drill bit of claim 1, wherein the at least one interior displacement element is a single interior displacement element disposed in a space that passes through the longitudinal axis of the body of the drill bit.

6. The drill bit of claim 1, wherein each interior displacement element extends in a radially outward direction away from the longitudinal axis of the drill bit through a space located between a nozzle formed in the body and a corresponding one of the plurality of blades of the body adjacent the nozzle, and wherein the interior displacement element extends laterally away from a leading edge of the corresponding one of the plurality of blades as the interior displacement element extends in the radially outward direction.

7. The drill bit of claim 6, wherein a plurality of nozzles are formed in the body.

8. The drill bit of claim 7, wherein each interior displacement element extends in a different radially outward direction away from the longitudinal axis of the drill bit through a space located between one of the plurality of nozzles and a corresponding one of the plurality of blades adjacent the one of the plurality of nozzles, and wherein each interior displacement element extends laterally away from a leading edge of the corresponding one of the plurality of blades as the interior displacement element extends in the radially outward direction.

9. The drill bit of claim 7, wherein the at least one interior displacement element is a single interior displacement element that extends in multiple radially outward directions away from the longitudinal axis of the drill bit through spaces located between each of the plurality of nozzles and corresponding blades adjacent the nozzles, wherein the interior displacement element extends laterally away from a leading edge of each of the corresponding blades as the interior displacement element extends radially outward.

10. A drill bit comprising:

a body;

a plurality of blades on the body;

a plurality of cutting elements on at least one of the plurality of blades;

a reinforcement material forming portions of the body and the plurality of blades;

a binder material infiltrated through the reinforcement material to form a composite material and forming portions of the body and the plurality of blades; and at least one area located in an interior region of the body surrounded by the composite material wherein an interior displacement element at least partially displaced the reinforcement material therefrom;

wherein at least one of the areas located in the interior region of the body extends in a radially outward direction away from a longitudinal axis of the drill bit through a space located between a nozzle formed in the body and a corresponding one of the plurality of blades of the body adjacent the nozzle, and wherein the area extends laterally away from a leading edge of the corresponding one of the plurality of blades as the area extends in the radially outward direction; and wherein the at least one area is not distributed uniformly throughout the composite material that forms the body and the plurality of blades.

11. The drill bit of claim 10, wherein the area located in the interior region of the body comprises a binder-rich area, wherein the binder-rich area is a portion of the composite material that comprises a greater concentration of the binder material and a lesser concentration of the reinforcement material than other portions of the composite material within the body.

12. The drill bit of claim 10, wherein the area located in the interior region of the body comprises an empty space or void left where the interior displacement element was previously located.

13. The drill bit of claim 10, wherein the interior displacement element comprises a foam.

14. A method of making a matrix drill bit comprising:

placing at least one interior displacement element in a region of a matrix bit body mold corresponding to an interior region of a bit body formed using the matrix bit body mold, wherein the at least one interior displacement element is not placed with a uniform distribution throughout the region of the matrix bit body mold, and wherein at least one of the interior displacement elements extends in a radially outward direction away from a longitudinal axis of the matrix bit body mold through a space located between a nozzle location of the matrix bit body mold and a corresponding one of a plurality of blade portions of the matrix bit body mold adjacent the nozzle location, wherein the interior displacement element extends laterally away from a leading edge of the corresponding one of the plurality of blade portions as the interior displacement element extends in the radially outward direction;

placing a reinforcement material in the matrix bit body mold;

placing a binder material in the matrix bit body mold on top of the reinforcement material and surrounding the interior displacement element;

heating the matrix bit body mold, the reinforcement material, the interior displacement element, and the binder material to a temperature above the melting point of the binder material;

infiltrating the reinforcement material with the binder material; and cooling at least the matrix bit body mold, the reinforcement material, and the binder material to form a matrix composite drill bit body.

15. The method of claim 14, wherein the interior displacement element melts, dissolves, or otherwise degrades prior to the step of cooling the matrix bit body mold, the reinforcement material, and the binder material.

16. The method of claim 14, wherein the interior displacement element comprises at least one material selected from the group consisting of: an open-cell foam, a closed-cell foam, wool, a ceramic material, a metallic material, a cement, a polymeric material, and any combination thereof.

17. A drilling system, comprising:

a drill string; and a drilling tool coupled to the drill string, the drilling tool comprising:

a body, a plurality of blades on the body, a plurality of cutting elements on at least one of the plurality of blades, a reinforcement material forming portions of the body and the plurality of blades, a binder material infiltrated through the reinforcement material to form a composite material and forming portions of the body and the plurality of blades, and at least one interior displacement element located in an interior region of the body that is surrounded by the composite material;

wherein at least one of the interior displacement elements extends in a radially outward direction away from a longitudinal axis of the drilling tool through a space located between a nozzle formed in the body and a corresponding one of the plurality of blades of the body adjacent the nozzle, wherein the interior displacement element extends laterally away from a leading edge of the corresponding one of the plurality of blades as the interior displacement element extends in the radially outward direction; and wherein the at least one interior displacement element is not distributed uniformly throughout the composite material that forms the portions of the body and the plurality of blades.

18. The drilling system of claim 17, wherein the interior displacement element comprises at least one material selected from the group consisting of: an open-cell foam, a closed-cell foam, wool, a ceramic material, a metallic material, a cement, a polymeric material, and any combination thereof.

19. The drilling system of claim 17, wherein the interior displacement element comprises a foam.

20. The drilling system of claim 17, wherein the interior displacement element has an irregular cross-sectional shape.

* * * * *